US009828130B2

(12) United States Patent
Florian et al.

(10) Patent No.: US 9,828,130 B2
(45) Date of Patent: Nov. 28, 2017

(54) CONTAINER HANDLING MACHINE AND METHOD

(71) Applicant: Sidel S.p.A. con SOCIO UNICO, Parma (IT)

(72) Inventors: Godet Florian, Parma (IT); Stefano Molinari, Parma (IT); Raffaele Pace, Parma (IT)

(73) Assignee: SIDEL S.P.A. CON SOCIO UNICO, Parma (IT)

( * ) Notice: Subject to any disclaimer, the term of this patent is extended or adjusted under 35 U.S.C. 154(b) by 546 days.

(21) Appl. No.: 14/490,732

(22) Filed: Sep. 19, 2014

(65) Prior Publication Data

US 2015/0075117 A1 Mar. 19, 2015

(30) Foreign Application Priority Data

Sep. 19, 2013 (EP) ..... 13185243

(51) Int. Cl.
*B65C 3/16* (2006.01)
*B65C 9/04* (2006.01)
(Continued)

(52) U.S. Cl.
CPC ..... *B65C 3/16* (2013.01); *B65B 61/24* (2013.01); *B65C 9/04* (2013.01); *B65D 1/0261* (2013.01); *B67C 2003/226* (2013.01)

(58) Field of Classification Search
CPC .. B65B 61/24; B65C 3/14; B65C 3/16; B65C 9/04; B67C 3/045; B67C 3/223; B67C 2003/226; B65D 1/0261
See application file for complete search history.

(56) References Cited

U.S. PATENT DOCUMENTS 4,529,469 A * 7/1985 Jorss ..... B65C 9/04 156/360
4,594,123 A * 6/1986 Eder ..... B65C 3/16 156/456
(Continued)

FOREIGN PATENT DOCUMENTS

CN 102963549 A 3/2013
DE 1246520 B * 8/1967 ..... B65B 61/24
(Continued)

OTHER PUBLICATIONS

Office Action issued by the Chinese Patent Office in counterpart Chinese Patent Application No. 20140430012.9, dated Mar. 10, 2016, 9 pages.

*Primary Examiner* — Stephen F Gerrity
(74) *Attorney, Agent, or Firm* — Finnegan, Henderson, Farabow, Garrett, & Dunner, LLP

(57) ABSTRACT

A container handling machine including at least one operative unit comprising support means to support a shaped container, and a plunger selectively moved along a given axis to deform a base of the container from a first swollen configuration to a second configuration, in which the base is in part retracted inwardly of the container with respect to the first configuration so as to form a recess delimited by a boundary surface defining an internal volume of the container smaller than that in the first configuration. The plunger is provided with a shaped head interacting with the container base and comprising: first engaging means and an interacting surface.

15 Claims, 7 Drawing Sheets

(51) Int. Cl.

| | |
|---|---|
| ***B65B 61/24*** | (2006.01) |
| ***B65D 1/02*** | (2006.01) |
| *B67C 3/22* | (2006.01) |

(56) References Cited

U.S. PATENT DOCUMENTS

| | | | | |
|---|---|---|---|---|
| 5,137,136 | A * | 8/1992 | Humele | B65C 9/065 156/567 |
| 5,150,782 | A * | 9/1992 | Richter | B65C 9/065 198/379 |
| 5,464,495 | A * | 11/1995 | Eder | B65C 3/16 156/446 |
| 8,479,475 | B2 * | 7/2013 | Van Steen | B67C 3/008 141/82 |
| 2007/0284958 | A1 * | 12/2007 | Zacche' et al. | B65C 9/04 310/91 |
| 2008/0000323 | A1 * | 1/2008 | Zacche' et al. | B65C 9/04 74/813 R |
| 2009/0218003 | A1 * | 9/2009 | Miyazaki et al. | B67C 3/045 141/4 |
| 2009/0293436 | A1 * | 12/2009 | Miyazaki et al. | B65D 1/0261 53/471 |
| 2010/0199611 | A1 | 8/2010 | Pedmo et al. | |

FOREIGN PATENT DOCUMENTS

| | | | | |
|---|---|---|---|---|
| DE | 2102319 | A1 * | 8/1972 | B65D 79/005 |
| DE | 3622179 | A1 * | 1/1988 | B65C 3/16 |
| DE | 102008026244 | A1 | 12/2009 | |
| WO | WO 2006/068511 | | 6/2006 | |

* cited by examiner

CONTAINER HANDLING MACHINE AND METHOD

CROSS-REFERENCE TO RELATED APPLICATIONS

This application claims the benefit of priority of European Patent Application No. 13185243.6, filed Sep. 19, 2013, which is incorporated herein by reference.

TECHNICAL FIELD

The present invention relates to a machine and a method for handling containers, such as for example plastic bottles.

More specifically, the present invention relates to a machine and a method for labelling and transforming filled and closed containers.

The present invention is advantageously but not exclusively applicable in the sector of plastic hot fill containers, which the following description will refer to, although this is in no way intended to limit the scope of protection as defined by the accompanying claims.

BACKGROUND ART

As known, the containers of the above mentioned type, after having been filled with hot—for example at about 85° C.—pourable products or liquids, are first subjected to a capping operation and then cooled so as to return to a room temperature. By effect of the capping operation, the heated air present in the top portion ("head space") of the container expands causing a stress tending to produce a general swelling of the container at the side wall and at the base wall.

The following cooling to which the container is subjected, causes, vice versa, a reduction of the volume of air and minimally of the liquid product contained in the container; a depression is therefore created, which tends to pull the side walls and the base wall of the container inwards. This may determine deformations in the walls of the container if these are not rigid enough to resist the action of the above disclosed stresses.

In order to contain the depressive stresses generated during the cooling of the product within the containers without generating undesired deformations on the containers, they are typically provided, at the side wall, with a series of vertical panels, known as "vacuum panels". These panels, in the presence of depressive stresses, are deformed inwardly of the container allowing it to resist to the hot fill process without generating undesired deformations in other areas of the container.

Likewise, the known containers intended to be subjected to a hot fill process can also have an optimised lower portion or base adapted to be deformed upwards under the action of the depressive stresses.

Even though the disclosed solutions allow to "relieve" the pressure stresses on specific parts of the containers, i.e. the vertical vacuum panels or the base, thus avoiding the occurrence of undesired deformations in other parts of the containers, they do not allow the cancellation of the above said stresses; in other words, the containers remain in any case subject to internal depressive stresses and must therefore be provided with a structure capable of resisting such stresses.

Patent application WO2006/068511 shows a container having a deformable base, which can have two different configurations: a first unstable configuration, in which this base has a central area projecting downwards with respect to the outermost annular area immediately adjacent thereto, and a second stable configuration, in which the central area is retracted inwardly of the container, i.e. it is arranged in a higher position with respect to the adjacent annular area.

Following the filling with the hot pourable product, the base of the container has the first unstable configuration and must be supported by a special cup element to which it is coupled. Thereby, the downward deformation of the base of the container can be maximised without compromising the stable support of the container, since such a support is provided by the cup element. Following the cooling, the base can be displaced by an external action, for example a vertical thrust upwards performed by a rod or plunger, in the second stable configuration with the subsequent possibility of removing the cup element.

The displacement of the base of the container from the first to the second configuration determines a considerable reduction of the containment volume of the container, much higher than would be obtained in the known containers simply by the deformation of the base by the effect of the sole depressive stresses; the final effect is therefore substantially the cancellation of the depressive stresses acting on the inside of the container.

The applicant has observed that this kind of operation may become quite critical, in particular when the time necessary to perform the deformation of the base of the container has to be strongly limited or reduced, for instance due to production constraints; in such cases, the plastic material may return at least in part towards the original first configuration after release of the plunger; this normally occurs when the plastic material has a reaction time exceeding the time for performing the operation of deformation.

The non-correctly formed containers have therefore to be rejected at the end of the production line.

Another problem posed in connection with the described containers is the complexity of the plant layout for producing them. In particular, the disclosed containers must be subjected to the following operations to achieve their final shape:

- a filling operation with the hot pourable product on a filling machine;
- a subsequent operation of capping on a capping machine;
- a cooling operation in an appropriate station;
- an inversion operation on a relative processing machine, in which the bases of the containers are mechanically displaced from the first to the second configuration;
- a labelling operation on a relative labelling machine; and possible further finishing operations if required.

As it is known, the filling machines, the capping machines and the labelling machines are generally rotating machines, in which the containers are fed on respective carousels. In particular, each carousel is provided with a plurality of operative units for receiving and processing the containers, uniformly distributed about the rotation axis of the carousel; more precisely, each operative unit is commonly provided with an element for supporting the relative container which maintains it in a predetermined position for carrying out the specific operation/s.

As can be easily noted, the process for the production of the above said finished containers is rather time-consuming and requires considerable room within the relative plants; in order to carry out the different operations indicated, it is necessary to provide a relatively high number of machines and conveyors adapted to transfer the containers from a machine to another.

A further problem posed in connection with the above-described containers is the correct application of the labels on the designated surfaces of such containers. In particular, in order to be applied in a correct way, a label requires a receiving surface having a well-defined geometry as well as a sufficient rigidity. This second feature of the receiving surface is particularly important for self-stick labels or pressure-sensitive labels.

DISCLOSURE OF INVENTION

It is therefore an object of the present invention to find a simple and cost-effective solution to solve at least one of the above described problems.

This object is achieved by a container handling machine in accordance with at least some embodiments in the present application.

The present invention further relates to a container handling method in accordance with at least some embodiments in the present application.

BRIEF DESCRIPTION OF THE DRAWINGS

A preferred embodiment is hereinafter disclosed for a better understanding of the present invention, by mere way of non-limitative example and with reference to the accompanying drawings, in which.

BEST MODE FOR CARRYING OUT THE INVENTION

Figure 1:
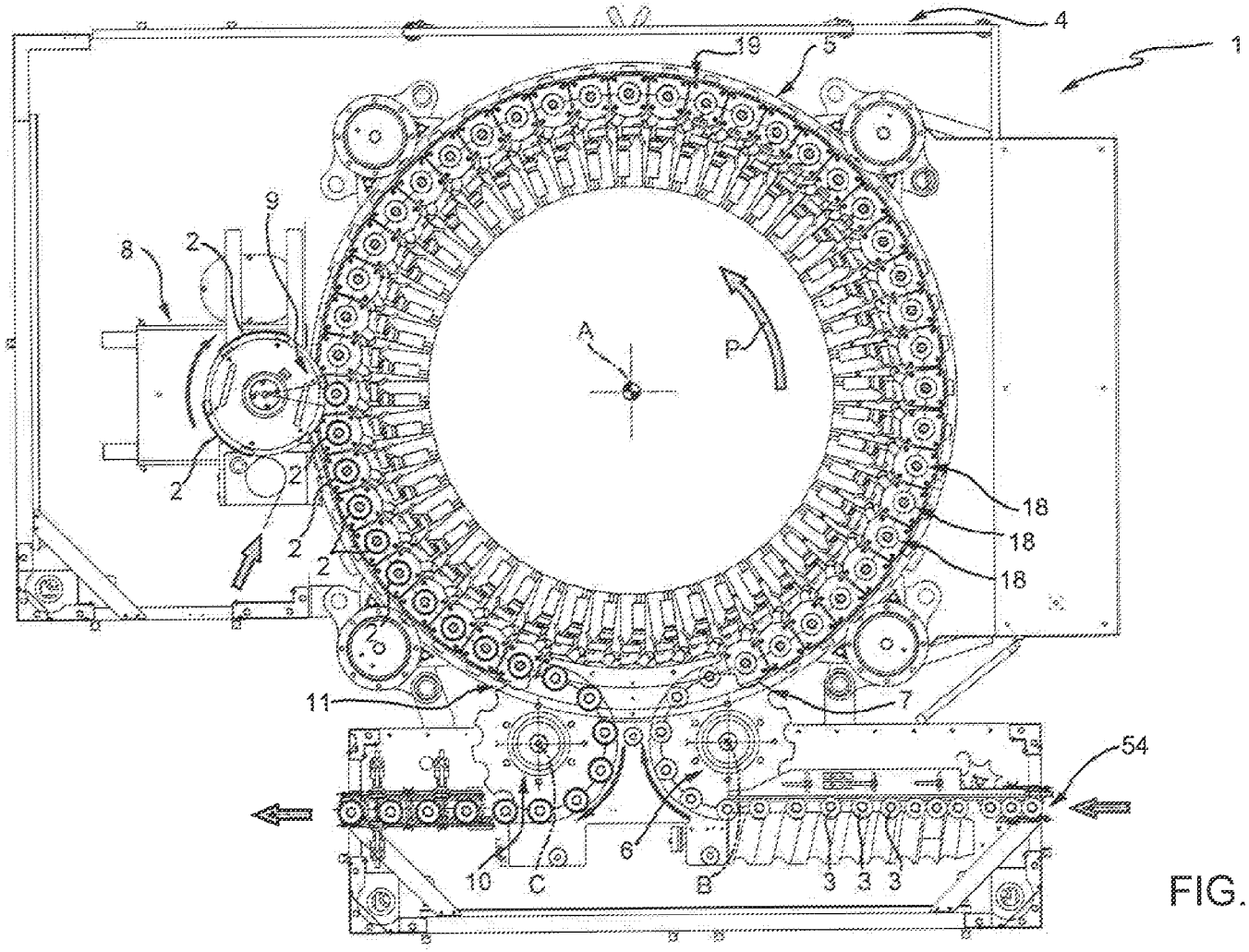
FIG. 1 shows a diagrammatic plan view with parts removed for clarity of a container handling machine according to the present invention.

With reference to FIG. 1, numeral 1 indicates as a whole a handling machine for applying labels 2 on filled and closed containers, in particular plastic bottles 3, and for deforming said bottles 3 so as to transform them into a desired final configuration.

Machine 1 essentially comprises a support structure 4 (only partially visible in FIG. 1) and a carousel 5 mounted on support structure 4 rotatably about a vertical central axis A.

Carousel 5 receives a sequence of bottles 3 to be labelled by an inlet star wheel 6, which cooperates with carousel 5 at a first transfer station 7 and is mounted to rotate about a respective longitudinal axis B parallel to axis A.

Carousel 5 also receives a sequence of rectangular or square labels 2 from a labelling unit 8 (known per se and only diagrammatically shown), which cooperates with carousel 5 at a second transfer station 9.

Carousel 5 releases a sequence of labelled bottles 3 to an outlet star wheel 10, which cooperates with carousel 5 at a third transfer station 11 and is mounted to rotate about a respective longitudinal axis C parallel to axes A and B.

Figure 2:
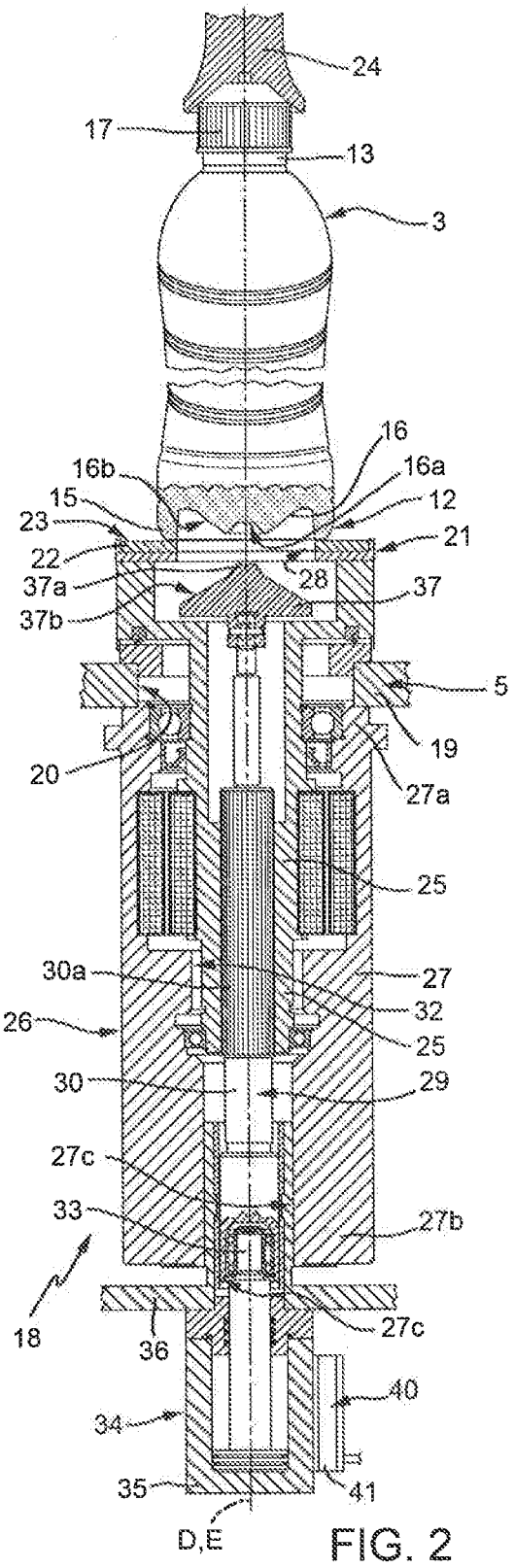
FIG. 2 is a partial sectional side view, on an enlarged scale, of an operative unit of the machine of FIG. 1, in a first condition.
Figure 3:
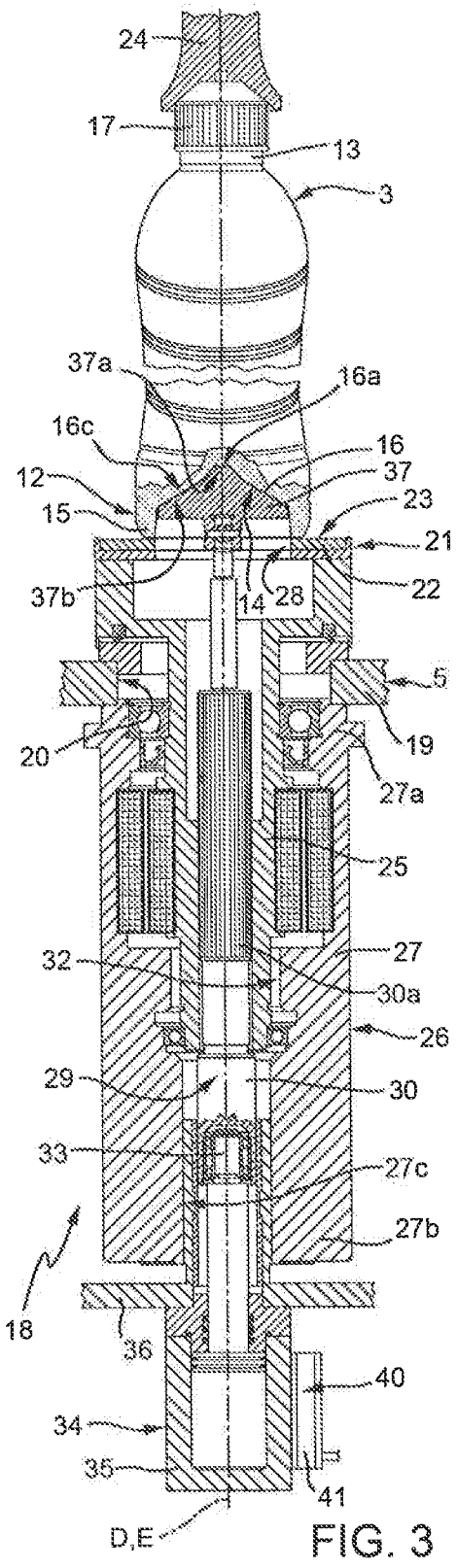
FIG. 3 is a partial sectional side view, on an enlarged scale, of the operative unit of FIG. 2, in a second condition.

As may be seen in detail in FIGS. 2 and 3, each bottle 3 has a longitudinal axis D, a base 12 and a neck 13 defining an opening (not visible) for pouring the product contained in bottle 3.

In the case shown, base 12 has an annular area 15 having axis D, radially external and defining an annular resting surface of relative bottle 3, and a central recessed area 16, surrounded by annular area 15 and arranged normally higher along axis D with respect to annular area 15 in a vertical position of bottle 3, i.e. with neck 13 placed above base 12; in other words, central area 16 is arranged at a distance from neck 13 along axis D smaller than the distance between neck 13 and annular area 15.

Base 12 is deformable and can have two different configurations, shown in FIGS. 2 and 3. In the first configuration (FIG. 2), central area 16 of base 12 is deformed and swollen downwards, i.e. it is arranged at a maximum distance from neck 13 along axis D so as to define a maximum internal volume of bottle 3; in the second configuration (FIG. 3), central area 16 is instead retracted inwardly of relative bottle 3 with respect to the first configuration, i.e. central area 16 is arranged at a smaller distance along axis D from neck 13 with respect to the first configuration. It is apparent that bottles 3 have, in the second configuration of base 12, a containing volume smaller than that in the first configuration.

Bottles 3 are fed to carousel 5 in a condition in which they have been filled with the pourable product, normally a liquid food product, and closed, at neck 13, with a relative closing device or cap 17.

In the case shown, bottles 3 are fed to carousel 5 after having been hot filled and subjected to a cooling operation. Base 12 is therefore arranged in the first configuration, i.e. it is deformed and swollen downwards, and within bottle 3 there are depressive stresses which tend to displace base 12 towards the second configuration.

As clearly visible in FIG. 2, in the first configuration, central area 16 has a central indentation **16*a*, whose function will be explained later on, and is externally bounded by a surface 16*b* having a truncated-cone shape and connecting indentation 16*a* to annular area 15; surface 16*b* has widening cross sections by proceeding along axis D towards neck 17**.

Bottles 3 reach carousel 5 in a vertical position, i.e. with base 12 arranged on the bottom with respect to neck 13 and to cap 17 and with axis D parallel to axes A, B and C.

Bottles 3 are released to outlet star wheel 10 with base 12 in the second configuration, which corresponds to the desired final configuration.

In particular, in the second configuration (FIG. 3), central area 16 defines a recess 14, which still has the same central indentation **16*a* but such indentation 16*a* is connected to annular area 15 by a surface 16*c* having a truncated cone shape with opposite conicalness with respect to surface 16*b***;

more specifically, surface 16*c*, which delimits externally recess 14, has tapering cross sections by proceeding along axis D towards neck 17.

Carousel 5 comprises a plurality of operative units 18 (only one of which shown in detail in FIGS. 2 and 3), which are uniformly distributed about axis A and are mounted at a peripheral portion of carousel 5.

Operative units 18 are displaced by carousel 5 along a circular processing path P which extends about axis A and through transfer stations 7, 9 and 11. In particular, by considering path P (FIG. 1), transfer station 7, in which bottles 3 are fed to carousel 5, is arranged upstream of transfer station 9 for feeding labels 2, and latter station 9 is clearly arranged upstream of transfer station 11, in which labelled bottles 3 are fed to outlet wheel 10.

As may be seen in FIGS. 2 and 3, operative units 18 are fixed to a horizontal rotating table 19 of carousel 5, have respective axes E parallel to axes A, B, C and orthogonal to path P, and extend coaxially through respective through-holes 20 of rotating table 19 and on both sides thereof.

Each operative unit 18 is adapted to receive a relative bottle 3 in a vertical position, i.e. having its axis D coaxial to relative axis E with neck 13 placed above base 12, and to retain this bottle 3 in the above said position along path P from transfer station 7 to transfer station 11.

Since operative units 18 are identical to one another, only one will be disclosed in detail hereinafter for clarity and simplicity; it is evident that the features that will hereinafter disclosed are common to all operative units 18.

In particular, operative unit 18 comprises, above rotating table 19, a support element 21 adapted to define a horizontal support for base 12 of a relative bottle 3. In greater detail, support element 21 comprises a plate 22 extending orthogonally to axis E and having, on top, a horizontal resting surface 23 for supporting base 12 of relative bottle 3. In practice, annular area 15 is the only part of bottle 3 contacting resting surface 23, being central area 16 retracted along axis D with respect to annular area 15 in both first and second configuration of base 12.

As can be seen in FIGS. 2 and 3, each bottle 3, when housed on relative operative unit 18, is also locked on top by a retaining member 24 cooperating with cap 17 of bottle 3.

Support element 21 is also fixed to a rotating member 25 of a relative electric motor 26, so as to be rotated about axis E when relative bottle 3 receives a label 2 from labelling unit 8.

In particular, electric motor 26 comprises a hollow cylindrical stator 27, protrudingly fixed to the lower side of rotating table 19 about hole 20 and coaxially thereto; more precisely, stator 27 has a top end 27*a* fixed to a lower face of rotating table 19 and protrudes on the lower side of rotating table 19.

Rotating member 25, also cylindrical and hollow, is mounted for the most part within stator 27 and projects on top therefrom so as to engage coaxially and pass through hole 20 of rotating table 19 of carousel 5. Rotating member 25 is mounted rotatingly about axis E with respect to stator 27 and to rotating table 19; in other words, rotating member 19 rotatingly engages hole 20 of rotating table 19.

Support element 21 finally protrudes from the top of rotating member 25.

Plate 22 of support element 21 has a through opening 28 coaxial to axis E, and operative unit 18 also comprises a plunger 29, borne by rotating table 19 of carousel 5 on the opposite side of support element 21 with respect to bottle 3, which is selectively displaceable along axis E, with respect to support element 21, to act, through opening 28, on base 12 of relative bottle 3 and deform it from the first to the second configuration.

In particular, plunger 29 has a substantially cylindrical main portion 30, which axially and slidingly engages a central through-hole 32 having axis E of rotating member 25 and is selectively displaceable between a first resting position, in which it is spaced from base 12 of bottle 3 borne by support element 21, and a second operative position, in which it engages opening 28 of support element 21 and cooperates with base 12 of bottle 3 to deform it from the first to the second configuration.

Preferably, plunger 29 is axially coupled to a piston 33 of a fluidic actuator assembly 34, for example of the pneumatic type.

According to another possible variant (not shown), plunger 29 may be coupled to, or be defined, by a linear motion mobile member.

According to another possible variant (not shown), plunger 29 may be driven by an electric motor coupled with a worm screw.

Actuator assembly 34 is arranged on the opposite side of electric motor 26 with respect to support element 21.

In the case shown, actuator assembly 34 comprises an outer housing 35 which protrudes by means of a flanged sleeve 36 to a lower end 27*b* of stator 27, opposite to end 27*a* and provided with a through hole 27*c*.

Piston 33 is partially engaged in a sliding manner along axis E in housing 35 and projects on top therefrom with an end portion coupled to plunger 29.

Preferably, plunger 29 is axially coupled to piston 33 so that they can move as one single piece along axis E, and is rotationally free with respect to piston 33 so that any rotational movement impressed by rotating element 25 to plunger 29 is not transmitted to piston 33.

As may be seen in FIGS. 2 and 3, main portion 30 of plunger 29 engages hole 27*c* of end 27*b* of stator 27 and hole 32 of rotating element 25 in a sliding manner and ends on top with a shaped head 37 which interacts with base 12 of relative bottle 3.

Shaped head 37 of plunger 29 advantageously has:

- one central axial protrusion 37*a* complementary to the profile of indentation 16*a* of base 12 of bottle 3 and adapted to be coupled to the indentation 16*a* in the first configuration of base 12 for centering the bottle 3 along axis E prior to start deformation of such base 12; and
- an interacting surface 37*b* distinct from protrusion 37*a* and complementary to the profile of surface 16*c* of recess 14 of base 12 in the second configuration.

In other words, protrusion 37*a* fully reproduces the profile of indentation 16*a* in negative so as to perfectly match with it when protrusion 37*a* and indentation 16*a* are coupled to one another for centering the relative bottle 3 along axis E prior to start deformation of base 12. In a completely analogous manner, even interacting surface 37*b* fully reproduces in negative the profile of the surface 16*c* of the recess 14 to be obtained during deformation of base 12; this particular profile of interacting surface 37*b* permits to aid and improve deformation of the base 12 of each bottle 3 so as to avoid any possible partial return of plastic material to initial condition.

As it appears from FIGS. 2 and 3, interacting surface 37*b* has an annular configuration and extends around protrusion 16*a*. Interacting surface obviously has a truncated-cone shape like surface 16*c* of recess 14 of base 12 in the second configuration.

It should be noted that, in the first position of plunger 29 (FIG. 2), head 37 is spaced from base 12 of the relative bottle 3 and is in particular located below the plane defined by resting surface 23, so as to not hamper feed or release of each bottle 3 to/from the relative operative unit 18.

In the second position of plunger 29, protrusion 37*a* of head 37 is coupled and matches with indentation 16*a* of base 12 of the relative bottle 3, and interacting surface 37*b* is coupled and matches with surface 16*c* of recess 14 of the base 12 in the second configuration.

The applicant has observed that the stroke or displacement of plunger 29 from its first to second position can be varied to obtain different deformations of bases 12 of bottles 3 so as to produce given increases of the internal pressures of the closed bottles 3 along with consequent increases of the rigidity of the outer surfaces of the bottles 3 designed to receive labels 2.

Figure 4:
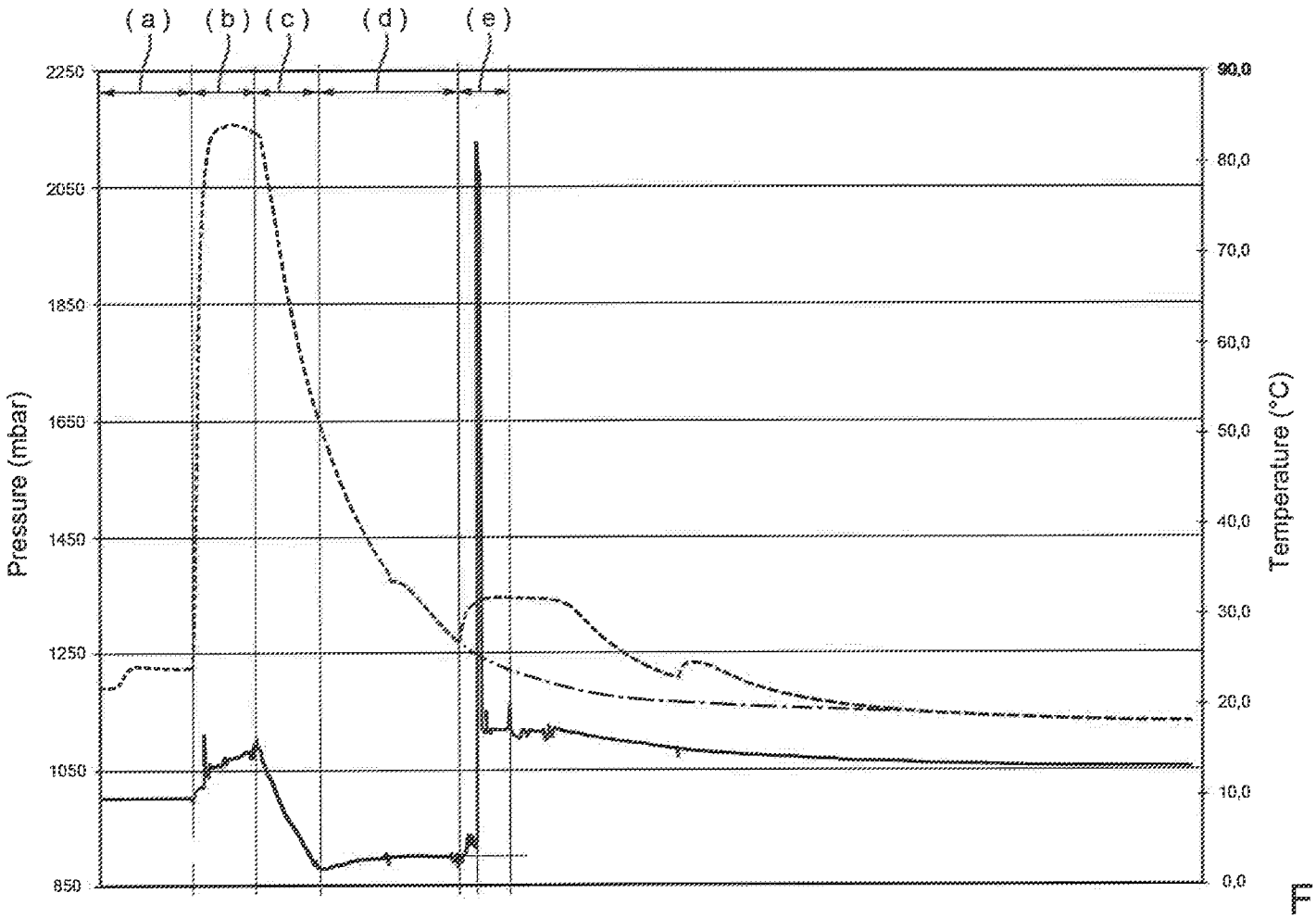
FIG. 4 is a graph showing variation of temperature and internal pressure in containers during handling thereof.

The graph of FIG. 4, shows the variation of temperature and internal pressure in a bottle 3 during the different steps of:

filling with a hot product;

closing with a relative cap 17;

cooling; and deforming the relative base 12.

Figure 6:
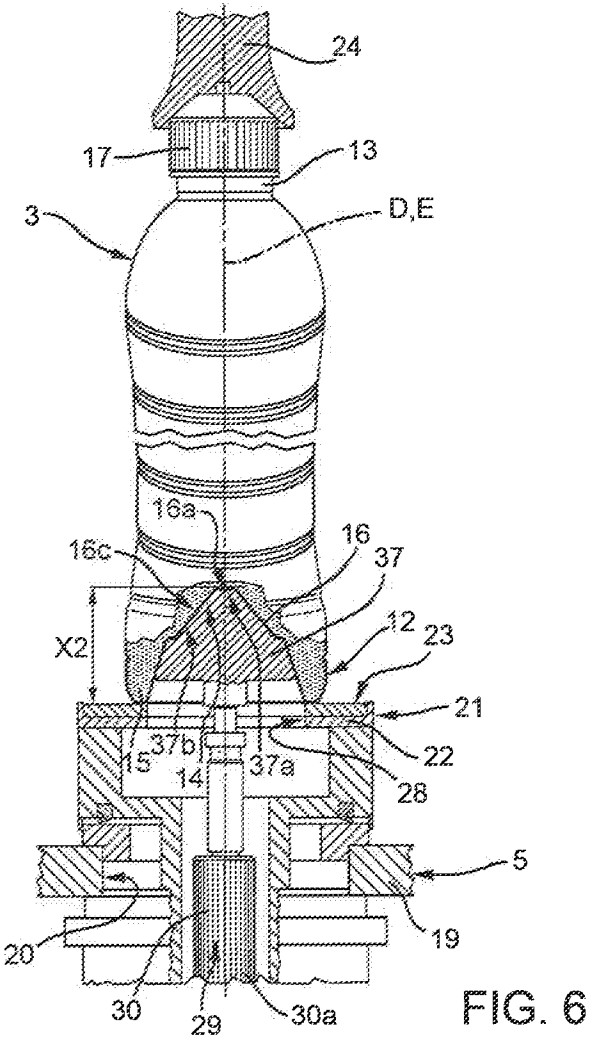
FIG. 6 is a partial sectional side view, on an enlarged scale and with parts removed for clarity, of another possible variant of the operative unit of FIGS. 2 and 3, in the second condition.
Figure 5:
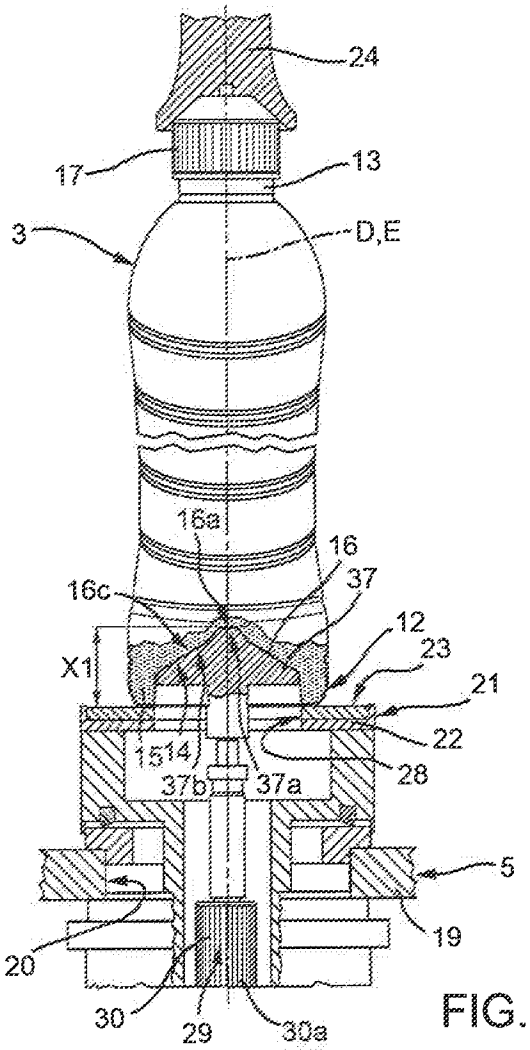
FIG. 5 is a partial sectional side view, on an enlarged scale and with parts removed for clarity, of a possible variant of the operative unit of FIGS. 2 and 3, in the second condition.

In particular, the applicant has observed that, in order to obtain a sufficient rigidity of the outer surface of a bottle 3 to perform labelling, head 37 of plunger 12 in its second position has to protrude from resting surface 23 of a quantity along axis E ranging between 22 mm (X1, see FIG. 5) to 40 mm (X2, see FIG. 6) so as to produce an increase of the internal pressure of the bottle 3 ranging between 150 mbar and 300 mbar.

Figure 7:
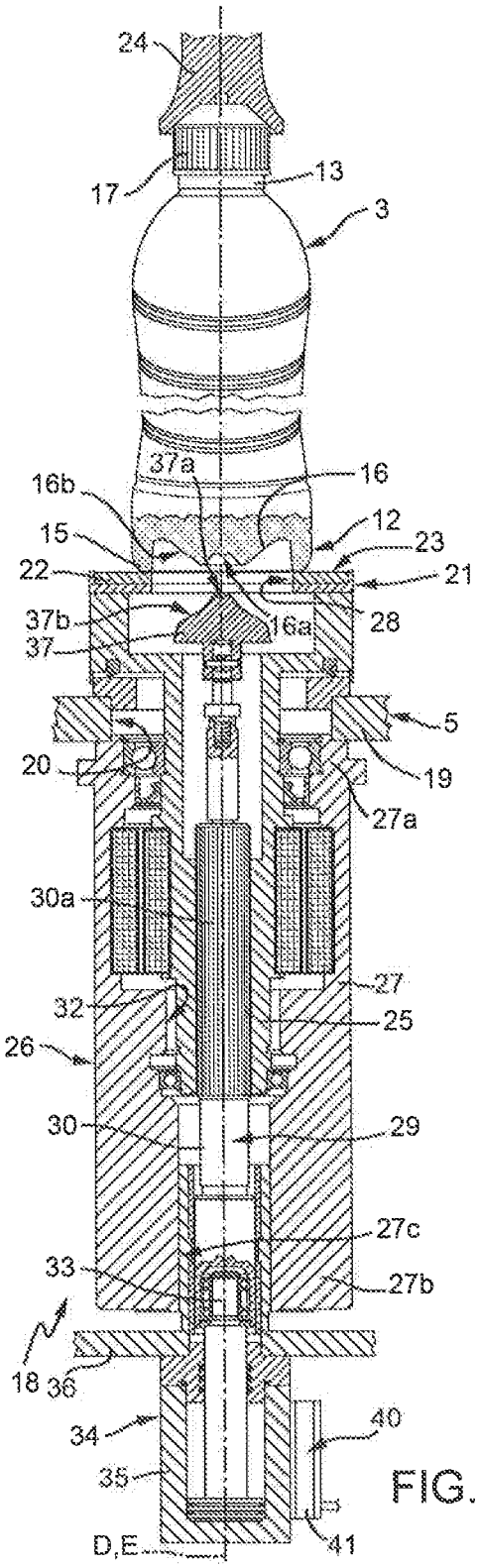
FIG. 7 is a partial sectional side view, on an enlarged scale, of a further possible variant of the operative unit of FIGS. 2 and 3, in the first condition.
Figure 8:
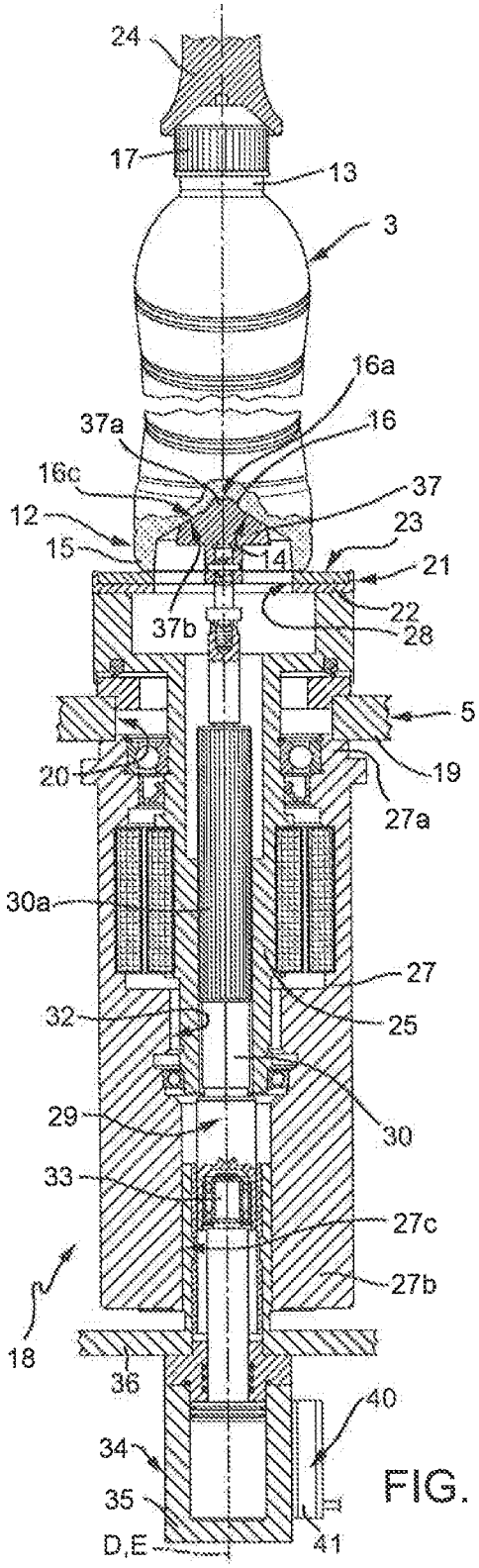
FIG. 8 is a partial sectional side view, on an enlarged scale, of the operative unit of FIG. 7, in the second condition.

In FIGS. 7 and 8, a possible variant is shown of head 37 of plunger 29. In this case, interacting surface 37*b* is only complementary to a portion of the profile of surface 16*c* of recess 14 of base 12 in the second configuration, in particular to the portion immediately adjacent to indentation 16*a*.

To sum up, in the disclosed configurations of operative unit 18, stator 27, rotating member 25, support element 21, actuator assembly 34 and plunger 29 move with rotating table 19 about axis A.

As shown in FIGS. 2 and 3, main portion 30 of plunger 29 has a splined zone 30*a* angularly coupled with rotating member 25; therefore, in addition to the rotational movement about axis A, rotating member 25, support element 21 and plunger 29 can rotate about axis E with respect to the other components of operative unit 18.

Finally, plunger 29 and piston 33 can translate along axis E with respect to the other components of operative unit 18.

Preferably, operative unit 18 also comprises sensor means 40 adapted to detect the displacement along axis E performed by plunger 29 to bring base 12 of relative bottle 3 from the first configuration to the second configuration.

In the case shown, sensor means 40 comprise a position transducer 41 (known per se) adapted to detect the position of piston 33 during its movements; in practice, position transducer 41 generates an outlet signal correlated to the position taken by piston 33. On the basis of the position of piston 33 before and at the end of the interaction stroke with base 12 of relative bottle 3, the extent of the displacement of piston 33 and therefore of plunger 29 can be determined. By monitoring the displacement of plunger 29 during every action on bottles 3, it is possible to detect by how much this measured displacement differs from a range of desired values; this measure allows to indirectly perform a quality control of bottle 3.

Figure 9:
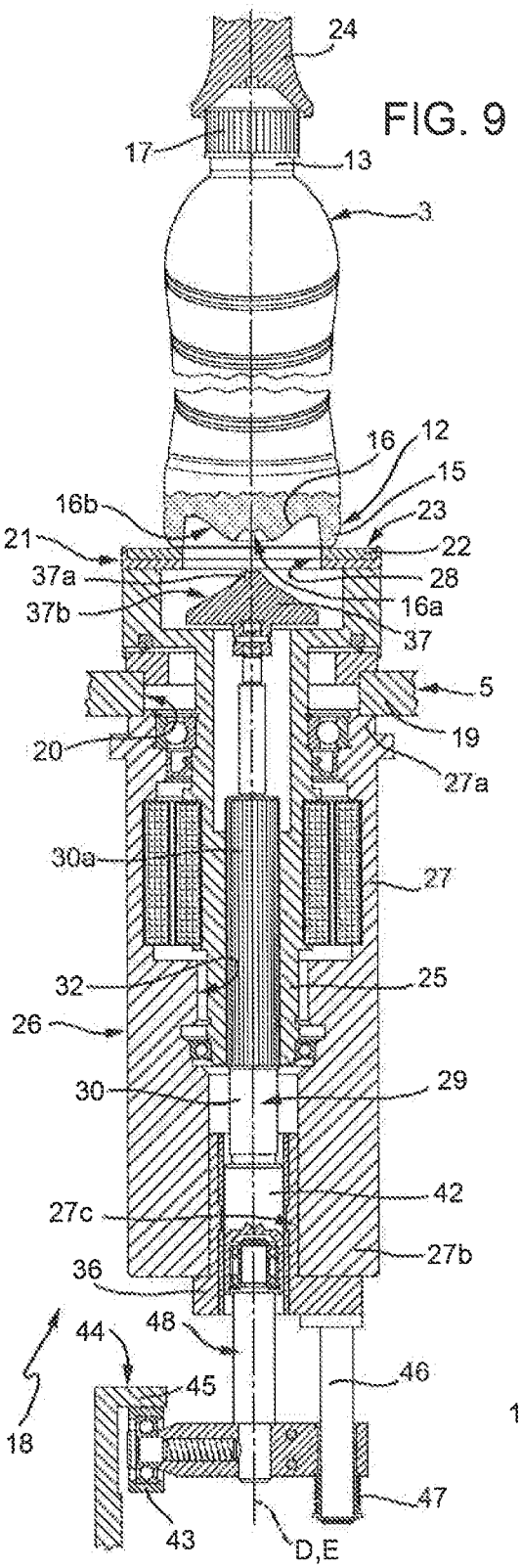
FIG. 9 is a partial sectional side view, on an enlarged scale, of an additional possible variant of the operative unit of FIGS. 2 and 3, in the first condition.
Figure 10:
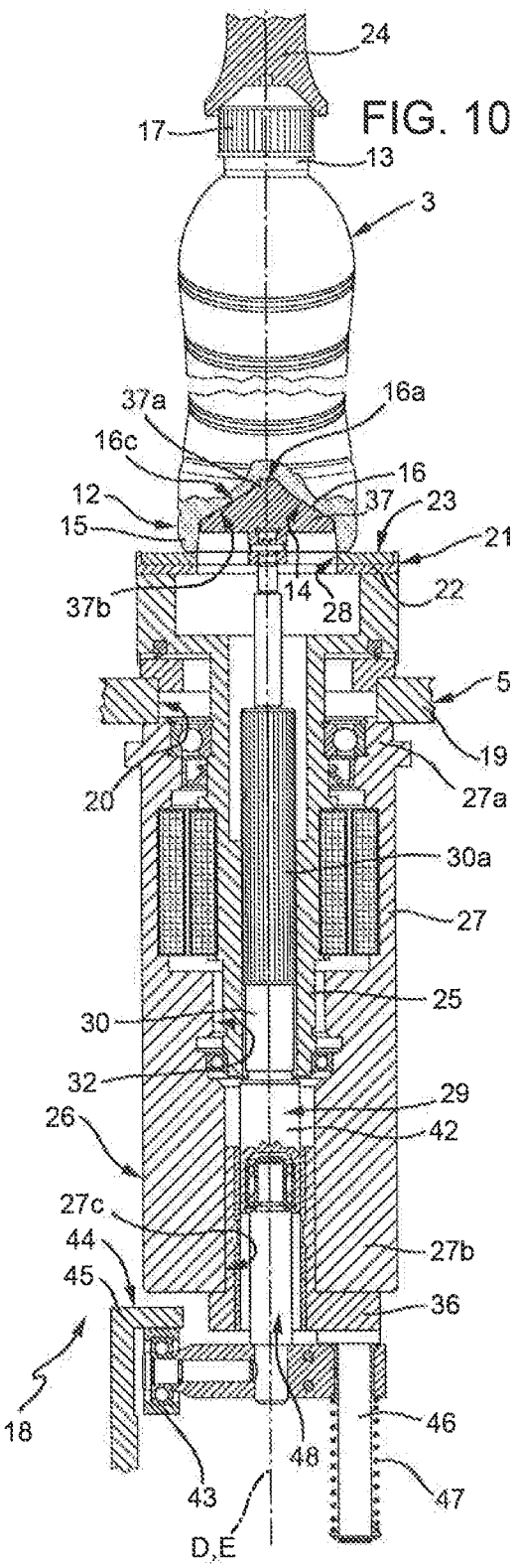
FIG. 10 is a partial sectional side view, on an enlarged scale, of the operative unit of FIG. 9, in the second condition.

In FIGS. 9 and 10, a possible variant is shown of the displacement system of plunger 29 of each operative unit 18 is shown. In this case, each plunger 29 is connected, at a lower end 42 thereof, opposite to head 37, to a cam follower 48 in turn provided with a roller 43 adapted to cooperate in a sliding manner with a fixed annular cam 44 during the displacement of relative operative unit 18 along path P.

Also in this case, cam 44 is arranged on the opposite side of electric motor 26 with respect to support element 21.

In particular, cam 44 is fixed to support structure 4, extends about axis A at the periphery of carousel 5 and cooperates, along a lower side thereof, with rollers 43 of plungers 29 of operative units 18. More precisely, cam 44 extends parallel to path P and has an operative portion 45 configured so as to determine the displacement of each plunger 29 from the first position to the second position and vice versa. Operative portion 45 is placed in a predetermined angular position with reference to axis A.

Roller 43 of each operative unit 18 is engaged in a sliding manner on a bracket 46 protruding on the lower side, by means of relative sleeve 36, from lower end 27*b* of relative stator 27 and extending parallel to relative axis E; a cylindrical helical spring 47 is wound about a lower end of relative bracket 46 and cooperates with relative roller 43 so as to load it elastically against cam 44.

Figure 11:
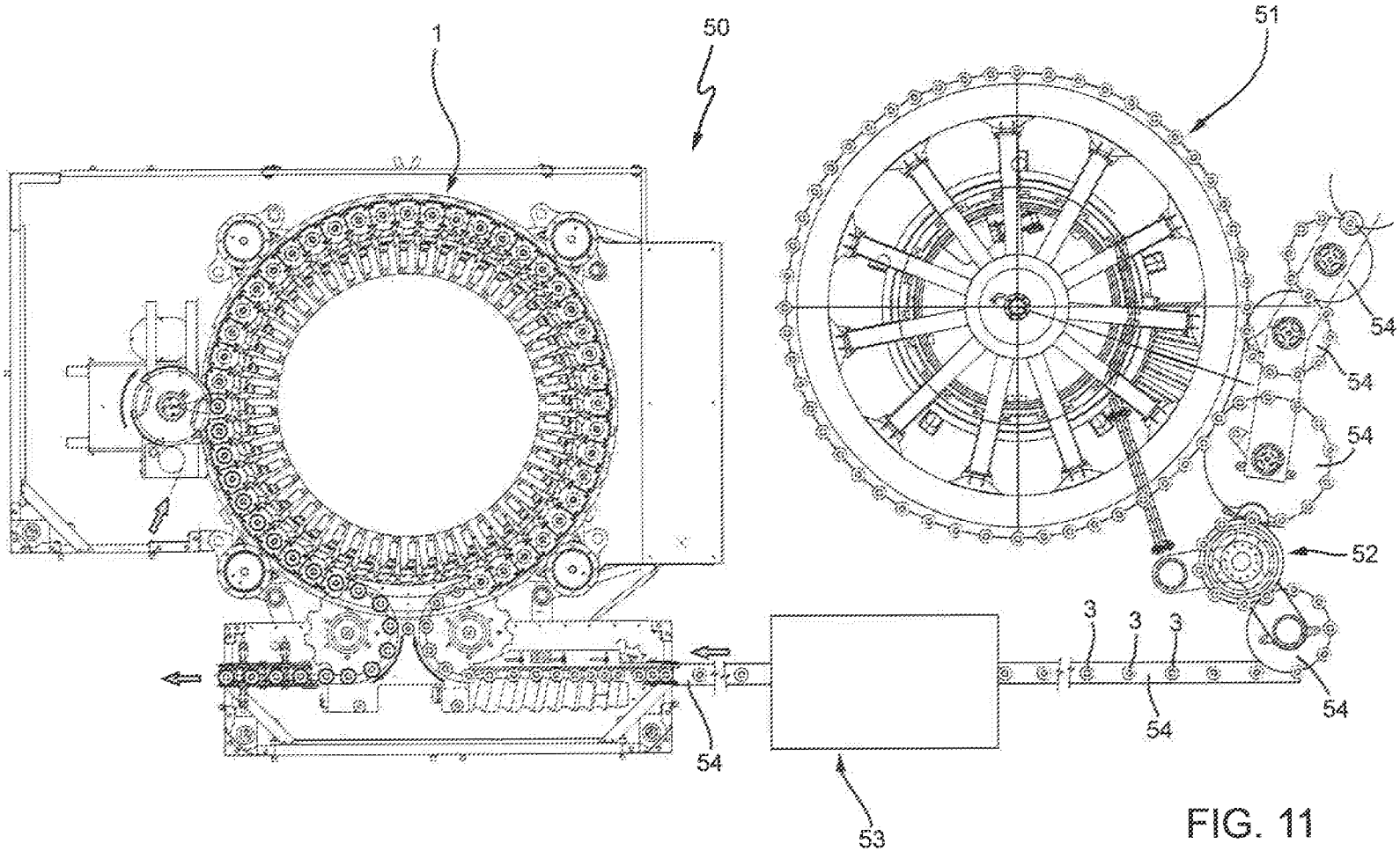
FIG. 11 is a diagrammatic plan view of a processing plant for containers including the handling machine of FIG. 1.

An example of a processing plant for bottles 3, indicated as a whole by numeral 50 and including labelling machine 1, is diagrammatically shown in FIG. 11.

In particular, plant 50 comprises:

- a filling machine 51 for filling bottles 3 with a hot pourable product;
- a capping machine 52, arranged downstream of filling machine 51 and adapted to close bottles 3 with respective caps 17;
- a cooling unit 53, arranged downstream of capping machine 52 and adapted to cool the product contained in closed bottles 3; and
- a plurality of conveyors 54, of the star or linear type, for transferring bottles 3 within plant 50.

Machine 1 is advantageously arranged immediately downstream of cooling unit 53 so that bottles 3 exiting this unit are transferred to machine 1 only through linear or star conveyors 54, without intermediate process stations.

In practice, no processing is performed on bottles 3 during their transfer from cooling unit 53 to machine 1.

In use, bottles 3 are filled on filling machine 51 with a hot pourable product, for example a liquid food product at about 85° C. (step (b) in FIG. 4). In practice, empty bottles 3 are fed to filling machine 51 (step (a) in FIG. 4) by an inlet conveyor 54, in the case shown a star conveyor, and after being filled, exit filling machine 51 through an outlet conveyor 54, also of the star type. From here bottles 3 reach capping machine 52, where they are closed with respective caps 17 (step (c) in FIG. 4).

By the effect of the capping operation, heated air present in the top portion of each bottle 3, between the product and relative cap 17, expands causing a stress that tends to produce a general swelling of bottle 3. During this step, bases 12 of bottles 3 are deformed assuming the first configuration shown in FIGS. 2, 7 and 9.

It may be noted, also in the above said first deformed configuration, that central area 16 of base 12 does not project downwards beyond adjacent annular area 15; thereby, annular area 15 always ensures a stable support for relative bottle 3.

At this point, bottles 3 are fed to cooling unit 53 where the product contained therein is taken to the desired temperature (step (d) in FIG. 4). During this step, depressive stresses are generated within bottles 3 and tend to shrink them.

Bottles 3 exiting cooling unit 53 are fed, through a linear conveyor 54, directly to inlet wheel 6 and, from here, reach in a sequence the different operative units 18 of machine 1.

In practice, each bottle 3 is arranged resting on plate 22 of a relative operating unit 18. Bottles 3 are fed to machine 1 in a vertical position, with axes D thereof parallel to central axis A and coaxial to axes E of respective operating units 18.

During the movement of bottles 3 from transfer station 7 to transfer station 9, respective plungers 29 are activated to bring relative bases 12 from the first to the second configuration and thus cancel the depressive stresses acting within bottles 3.

With particular reference to the solution shown in FIGS. 2 and 3, the displacement of plungers 29 is obtained by activating respective actuator assemblies 34.

In practice, considering a single operative unit 18, the activation of relative actuator assembly 34 causes the displacement along axis E of relative plunger 29 so that head 37 completely passes through opening 28 of relative support element 21. During this displacement, protrusion 37*a* of head 37 engages, and matches with, corresponding indentation 16*a* of base 12 of bottle 3 arranged resting on relative support element 21 so as to center such bottle 3 along respective axis E. After this centering step, the plunger 29 continues its movement along axis E and pushes central area 16 of base 12 upwards until it is taken to the second configuration. During such deformation action, surface 37*b* of head 37 cooperates with surface 16*b* of central area 16 so as to guide it during transformation into surface 16*c*. The action of shaped head 37 on base 12 gently "forces" central area 16 to take the profile in negative of surface 37*b*. In this way, the risks that, after deformation, the plastic material may return to its initial condition are minimized.

By carrying the head 37 of the plunger 29 to a maximum distance from the relative resting surface 23 ranging between 22 mm to 40 mm along axis E, it is possible to obtain an increase of the internal pressure of bottle 3 ranging between 150 mbar and 300 mbar; this pressure increase produces the desired stiffening of the outer surface of bottle 3, which enables a very precise and accurate application of a relative label 2.

In particular, the labelling operation is performed immediately after the operation of deformation of base 12 of bottle 3.

More specifically, at the end of the deformation operation, plunger 29 is maintained in its second position (FIG. 3) and the bottle 3 is ready to receive the relative label 2.

In order to obtain winding of the label 2 on the relative bottle 3, electric motor 26 of relative operative unit 18 is activated; relative support element 21 and plunger 29 are therefore rotated about axis E with a corresponding rotation of bottle 3 borne thereby; due to the particular coupling between plunger 29 and piston 33, this latter element does not rotate.

The application operation of the label 2 on the relative bottle 3 is thus completed along the remaining portion of path P, until bottle 3 is fed to outlet wheel 10 at transfer station 11.

Prior to release bottles 3 to outlet wheel 10, plungers 29 are moved along axis E to their first positions, so as to not hamper the lateral displacement of bottles 3 towards outlet wheel 10.

In the variant of FIGS. 9 and 10, the same strokes of plungers 29 between their first to their second positions are obtained through the interaction of rollers 43 with cam 44. In particular, the passage of roller 43 of a relative plunger 29 at operative portion 45 of cam 44 determines a corresponding axial displacement upwards and downwards of the plunger 29, with the subsequent interaction of its head 37 with base 12 of relative bottle 3 to take it to the second configuration.

As it appears from the above description, the particular shape of head 37 of each plunger 29 with protrusion 37*a* permits to center the relative bottle 3 along axis E prior to deform the relative base 12 and to apply the relative label 2. This centering action is obtained without using any external fixed centering element that may hamper feeding and release of bottles to/from carousel 5.

By configuring surface 37*b* in a complementary way to the profile of the desired final shape of surface 16*c* of base 12 of the relative bottle 3, such surface 37*b* performs a sort of "guiding action" on the deformation of the plastic material of base 12 so as to minimize the risks that, after deformation, this plastic material may return partially or totally to its initial condition.

Moreover, the fact that, each plunger 29 is maintained in the second position during labelling, i.e. after the deformation operation, further reduces the risks that the plastic material may return to its configuration before deformation.

It should be also noted that machine 1 is configured to perform both the labelling operation of bottles 3 and the operation of transforming bases 12 of bottles 3 from the first to the second configuration. This is obtained without modifying the path normally performed by operative units 18 on a typical labelling machine and without any intervention on the sequence of the operations traditionally performed to apply labels 2 on bottles 3.

Furthermore, the adoption of machine 1 within a normal processing plant of bottles 3 allows to obtain, the same operations being performed, a reduction both of the number of machines employed and of the number of conveyors for transferring the above said bottles 3 from a machine to another. This also translates into a significant reduction of the overall space occupied by processing plant 50 with respect to the known plants.

Finally, it is clear that modifications and variants to machine 1 and the method disclosed and shown herein can be made without departing from the scope of protection of the claims.

The invention claimed is:

1. A container handling machine, comprising:

at least one operative unit configured to handle a container having a base;

a carousel configured to advance the operative unit and the container along a processing path; and a labelling unit configured to apply a label onto an outer surface of the container while the operative unit and the container are being advanced by the carousel along the processing path, wherein the operative unit includes:

a support element configured to support the container;

a plunger selectively movable along an axis to deform the base of the container from a first configuration, in which the base is in an enlarged state that defines a first internal volume of the container, to a second configuration, in which the base is at least in part inwardly retracted with respect to the first configuration so as to form a recess delimited by a boundary surface defining a second internal volume of the container that is smaller than the first internal volume, wherein the plunger is provided with a head interacting with the base of the container, the head of the plunger including:

a first engaging portion having a profile complementary to a profile of a second engaging portion of the base of the container and adapted to be coupled to the second engaging portion in the first configuration of the base for centering the container along the axis prior to deformation of the base; and an interacting surface, distinct from the first engaging portion and having a profile complementary to a profile of at least part of the boundary surface of the recess of the base in the second configuration; and an actuator carried by the carousel configured to rotate the support element about the axis while the label is applied onto the container, wherein the plunger is moved along the axis between a first position, in which the head is spaced apart from the base of the container, and a second position, in which the first engaging portion is coupled to the second engaging portion and the interacting surface is coupled to the boundary surface of the recess of the base in the second configuration, and wherein the actuator is coupled to the plunger to rotate the plunger, set in the second position, together with the support element about the axis.

2. The machine of claim 1, wherein the operative unit is configured to receive filled and closed containers, the containers being filled with a hot product, closed and cooled.

3. The machine of claim 1, wherein the interacting surface of the head has a profile complementary to a profile of the entire boundary surface of the recess of the base in the second configuration.

4. The machine of claim 1, wherein the first and second engaging portions include one protrusion and one indentation coupled to one another during displacement of the plunger along the axis.

5. The machine of claim 1, wherein the interacting surface extends around the first engaging portion.

6. The machine of claim 1, wherein the support element includes a plate configured to support the base of the container and having a through opening through which the plunger is moved to deform the base of the container.

7. The machine of claim 6, wherein the plate includes a resting surface for supporting the base of the container, and wherein, in the second position, the head of the plunger protrudes from the resting surface by an amount along the axis ranging between 22 mm to 40 mm so as to produce an increase of an internal pressure of the container ranging between 150 mbar and 300 mbar.

8. The machine of claim 1, wherein the labelling unit is activated to apply the label onto the container while the plunger of the operative unit is in the second position and has completed deformation of the base of the container into the second configuration.

9. A method for handling a container having a base, the method comprising:

receiving the container in an operative unit having a support element for supporting the container;

advancing the operative unit and the container along a processing path; and applying a label onto an outer surface of the container while the operative unit and the container are being advanced along the processing path;

centering the container in the operative unit along an axis while the container is supported by the support element; and deforming, through a plunger moved along the axis, a base of the container from a first configuration, in which the base is in an enlarged state and defines a first internal volume of the container, to a second configuration, in which the base is at least in part inwardly retracted with respect to the first configuration so as to form a recess delimited by a boundary surface defining a second internal volume of the container that is smaller than the first internal volume;

wherein the centering is performed by a head of the plunger provided with a first engaging portion having a profile complementary to a profile of a second engaging portion of the base of the container and adapted to be coupled to the second engaging portion in the first configuration of the base prior to deforming the base of the container;

wherein the deforming is performed by pushing the head of the plunger against the base of the container along the axis so as to deform the base inwardly of the container;

wherein the head of the plunger also cooperates with the base of the container through an interacting surface, distinct from the first engaging portion and having a profile complementary to a profile of at least part of the boundary surface of the recess of the base in the second configuration, wherein the plunger is moved along the axis between a first position, in which the head is spaced apart from the base of the container, and a second position, in which the first engaging portion is coupled to the second engaging portion and the interacting surface is coupled to the boundary surface of the recess of the base in the second configuration, wherein the deforming is performed prior to applying a label, wherein the label is applied onto the container while the plunger of the operative unit is in the second position, and wherein the container and the plunger in the second position are rotated about the axis while the label is applied onto the container.

10. The method of claim 9, wherein the container is filled and closed before being received by the operative unit, the container being filled with a hot product, closed and cooled before being received by the operative unit.

11. The method of claim 9, wherein the interacting surface of the head of the plunger has a profile complementary to a profile of the entire boundary surface of the recess of the base in the second configuration.

12. The method of claim 9, wherein the first and second engaging portions include one protrusion and one indentation coupled to one another during displacement of the plunger along the axis.

13. A container handling machine comprising:

at least one operative unit for receiving a filled and closed container to be labelled and provided with a support element having a resting surface configured to support a base of the container;

a carousel for advancing the operative unit along a processing path from a feeding station of the container to an outlet station of the container; and a labelling unit for applying a label onto an outer surface of the container while the operative unit and the container are being advanced by the carousel along the processing path;

wherein the support element has a through opening having an axis transversal to the processing path;

wherein the operative unit includes a plunger on an opposite side of the support element with respect to a receiving position of the container and which can be selectively moved along the axis and through the opening to contact, with a free axial end of the plunger, the base of the container and deform the base from a first configuration, in which the base is in an enlarged state towards the resting surface and defines a first internal volume of the container, to a second configuration, in which the base is at least in part inwardly retracted with respect to the first configuration so as to define a second internal volume of the container that is smaller than the first internal volume;

wherein, at the end of the deforming action on the base of the container, the axial end of the plunger protrudes from the resting surface by a quantity along the axis ranging between 22 mm to 40 mm so as to produce an increase of an internal pressure of the container ranging between 150 mbar and 300 mbar along with a consequent increase of the rigidity of the outer surface of the container designed to receive the label, wherein the operative unit further includes an actuator carried by the carousel configured to rotate the support element about the axis while the label is applied onto the container, wherein the plunger is moved along the axis between a first position, in which a head of the plunger is spaced apart from the base of the container, and a second position, in which a first engaging portion of the head of the plunger is coupled to a second engaging portion of the base of the container and an interacting surface of the head of the plunger is coupled to a boundary surface of a recess of the base of the container in the second configuration, and wherein the actuator is coupled to the plunger to rotate the plunger, set in the second position, together with the support element about the axis.

14. The machine of claim 13, wherein the resting surface supporting the container is orthogonal to the axis.

15. The machine of claim 13, wherein the operative unit is configured to receive hot-filled containers, which are closed and cooled.

* * * * *